United States Patent [19]

Chen

[11] Patent Number: 4,899,560

[45] Date of Patent: Feb. 13, 1990

[54] LAMINATED PADLOCK

[76] Inventor: Chang-Yu Chen, 5, Lane 505, Fu-Shin S. Rd., Sec. 1, Ping-Tung City, Taiwan

[21] Appl. No.: 341,973

[22] Filed: Apr. 24, 1989

[30] Foreign Application Priority Data

Mar. 17, 1989 [TW] Taiwan ..... 78202389

[51] Int. Cl.[4] ..... E05B 67/02

[52] U.S. Cl. ..... 70/52

[58] Field of Search ..... 70/52, 54–56, 70/51, 370, 443, 448

[56] References Cited

U.S. PATENT DOCUMENTS

| | | | |
|---|---|---|---|
| 405,329 | 6/1889 | Smith | 70/52 |
| 2,744,404 | 5/1956 | Vile | 70/52 |
| 2,820,360 | 1/1958 | Soref et al. | 70/52 |
| 2,893,232 | 7/1959 | Foote et al. | 70/52 |
| 3,309,904 | 3/1967 | Niilola | 70/51 |
| 3,750,432 | 8/1973 | Errani et al. | 70/370 X |

FOREIGN PATENT DOCUMENTS

| | | | |
|---|---|---|---|
| 613854 | 1/1961 | Canada | 70/370 |
| 865398 | 3/1971 | Canada | 70/51 |
| 494178 | 3/1930 | Fed. Rep. of Germany | 70/52 |

*Primary Examiner*—Lloyd A. Gall

*Attorney, Agent, or Firm*—Nixon & Vanderhye

[57] ABSTRACT

A laminated padlock includes a casing which is formed of a plurality of metal plates and a barrel member mounted in the casing. The barrel member has a cylinder rotatably inserted thereinto and a groove formed on the outer surface of the barrel member. One of the plates of the casing is depressed inward to engage with the groove of the barrel member so that the barrel member can be fixed in the casing.

1 Claim, 3 Drawing Sheets

LAMINATED PADLOCK

BACKGROUND OF THE INVENTION

This invention relates to a laminated padlock, and more particularly to a laminated padlock having a casing which consists of a plurality of metal plates and a barrel member fitted therein, wherein said barrel member has a groove formed thereon and one of the plates of the casing is depressed to engage with said groove for the purpose of fixing said barrel member within said casing.

Referring to FIG. 1, a conventional laminated padlock is shown. The laminated padlock includes a casing 1 which consists of a plurality of metal plates, a shackle 11, a barrel member 12, a cylinder 121 rotatably fitted in the barrel member 12, an activating member 13 connected to the cylinder 121 so as to be rotated with said cylinder 121, two balls 14 driven by the activating member for restraining the upward movement of the shackle 11, and a coil spring 15 for urging the shackle 11 to move upward. While such a laminated padlock is assembled, the metal plates are singly electroplated by a metal, such as copper and tin, to ensure protection from rust. The metal plates are then collected in sequence and combined with one another by means of rivets 16. Thereafter, the coil spring 15, the balls 14, the activating member 13, the shackle 11, the barrel 12 and the cylinder 121 are mounted in the casing 1 respectively. The barrel 12 is then fixed to the casing 1 by means of a screw 17. Finally, a fixing plate 18 is riveted to the bottom of the casing 1. However, it has been found that such a laminated padlock suffers from the following disadvantages:

(1) The manufacture of said laminated padlock is messy and requires much work.

(2) While riveting, the appearance of the casing is affected adversely by striking and clamping the outer surface of the casing.

SUMMARY OF THE INVENTION

It is therefore an object of this invention to provide a laminated padlock which can be simply manufactured.

Another object of this invention is to provide a laminated padlock which retains a good appearance after assembly.

Accordingly, a laminated padlock of this invention includes a casing which is formed of a plurality of metal plates; a shackle having two ends to be inserted into said casing; a barrel member fitted in said casing, the barrel member having a bore into which a cylinder is rotatably inserted; an activating member connected with the cylinder in the casing so as to be rotated with the cylinder; two balls disposed adjacent to the activating member for restraining the movement of the shackle and a spring member mounted in the casing for urging the shackle to move outward. The improvements of the present invention comprise the barrel member, which has a groove formed on an outer surface thereof, and one of the plates which is depressed inward to engage with the groove of said barrel member so that said barrel member can be fixed in the casing. Such a fixing process will enable the laminated padlock to be easily assembled. In addition, the laminated padlock further has a sleeve member for covering an outer surface of the casing. The sleeve member has a protrusion projecting from an inner surface thereof so as to engage with a concave portion formed on the outer surface of the casing at a position where the plate is depressed. In this way, the laminated padlock retains a good appearance after assembly.

BRIEF DESCRIPTION OF THE DRAWINGS

Other features and advantages of this invention will become apparent in the following detailed description of a preferred embodiment of this invention with reference to the accompanying drawings, in which.

DETAILED DESCRIPTION OF A PREFERRED EMBODIMENT

Figure 1:
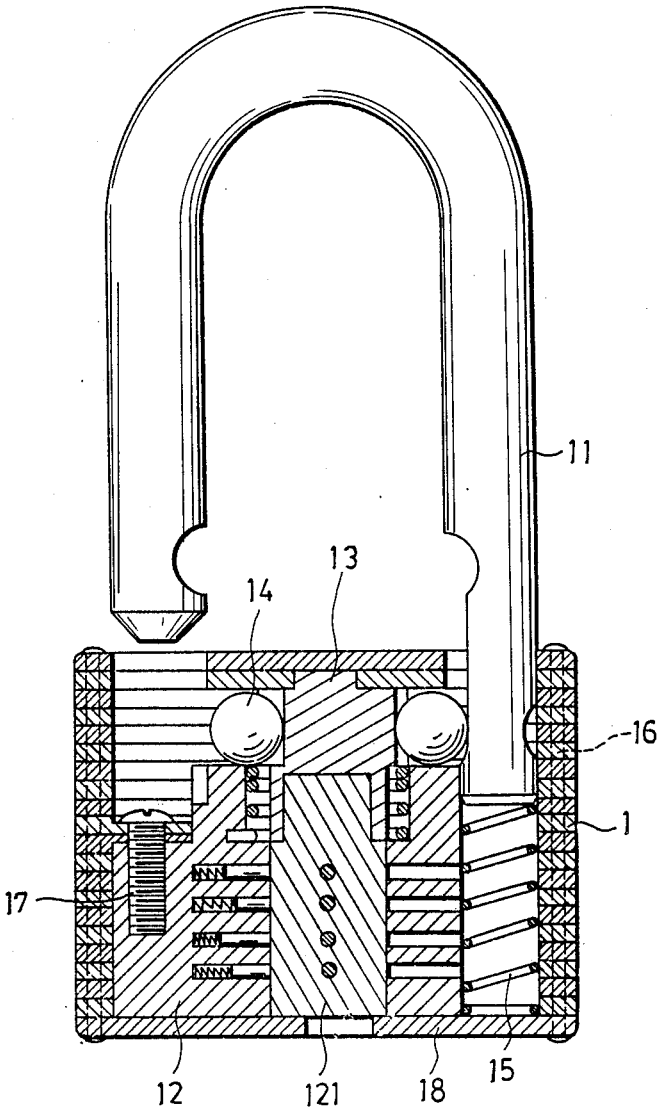
FIG. 1 (PRIOR ART)
FIG. 1 is a sectional view of a conventional laminated padlock.
Figure 2:
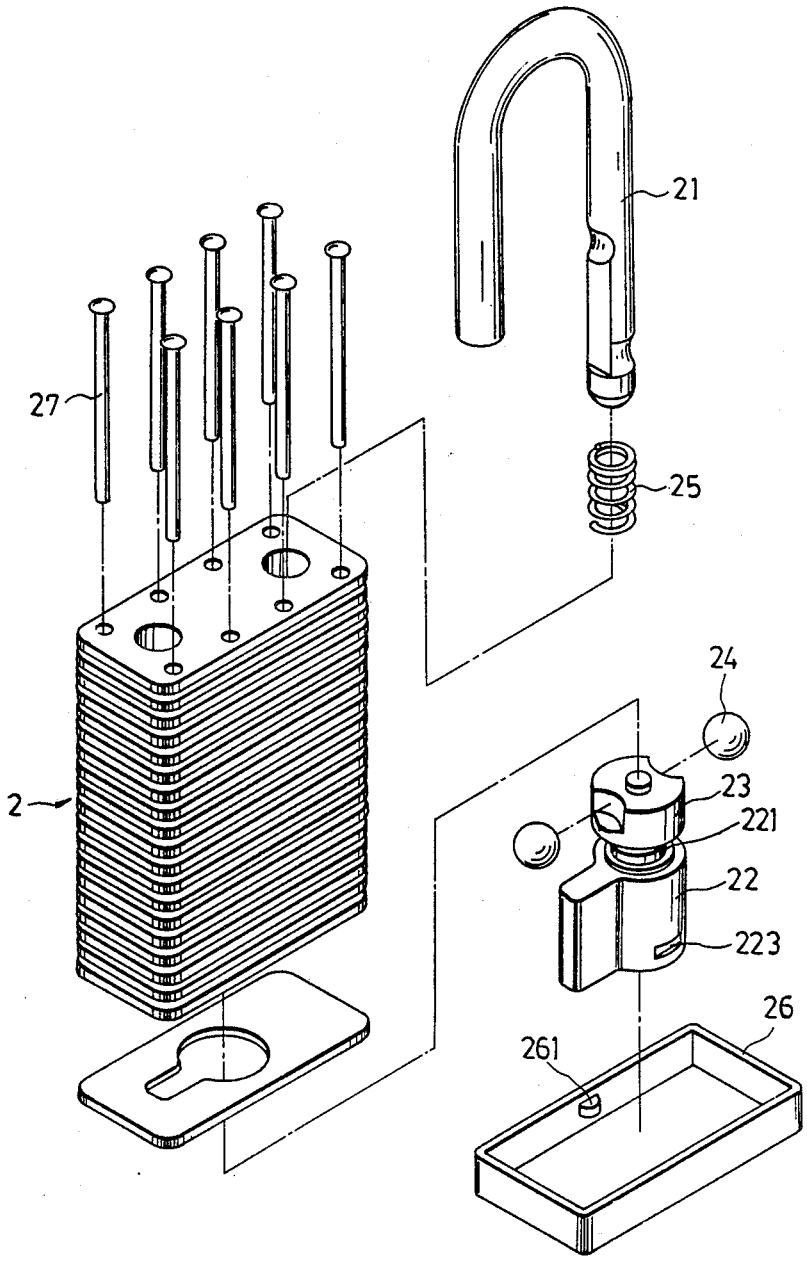
FIG. 2 is an exploded perspective view of a preferred embodiment of a laminated padlock of this invention.

Referring to FIG. 2, an exploded view of a preferred embodiment of a laminated padlock of this invention is shown. The laminated padlock includes a casing 2 which is formed by a plurality of metal plates, a shackle 21 having two ends to be inserted in the casing 2, a barrel member 22 fitted in the casing 2. The barrel member 22 has a bore into which a cylinder 221 is rotatably inserted. An activating member 23 is connected with said upper end of the cylinder 221 so as to be rotated with said cylinder 221. Two balls 24 are disposed adjacent to the activating member 23 for restraining the movement of the shackle 21. A coil spring 25 is mounted in the casing for urging the shackle 21 to move outward. The barrel member 22 has two grooves 223 formed on opposite sides of the outer surface thereof. A sleeve member 26 is further provided for covering the outer surface of the casing 2. The sleeve member 26 has two opposed protrusions 261 projecting from the inner surface thereof.

Figure 3:
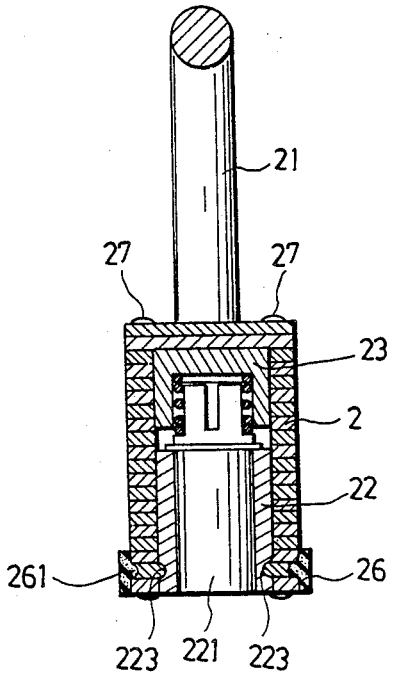
FIG. 3 is a sectional view of a preferred embodiment of a laminated padlock of this invention.

Referring to FIGS. 2 and 3, in accordance with the present invention, during assembly, the metal plates are engaged to one another by means of the rivets 27 so as to form the casing 2. The casing 2 is then electroplated. Thereafter, in sequence, the shackle 21, the barrel member 22 with the cylinder 221, the activating member 23, the balls 24 and the coil spring 25 are mounted in said electroplated casing 2. One of the plates of the casing 2, which is located at a position facing the grooves 223 of the barrel member 22, is depressed to engage with said grooves 223 of said barrel member 22 so that said barrel member 22 can be fixed in said casing 2, as best illustrated in FIG. 3. As a result, two concave portions are formed in the outer surface of the casing 2 on opposite sides thereof. The sleeve member 26 is then mounted to the casing 2 with the protrusions 261 of said sleeve member 26 fitting into said concave portions of the casing 2.

It can be appreciated that the laminated padlock of this invention has the following advantages:

(1) The laminated padlock is manufactured by means of a simple process, that is, collecting, riveting, electroplating, parts-assembling, depressing and sleeving. Instead of being riveted twice in manufacturing, the laminated padlock of this invention is only riveted once. Moveover, the plates of the casing 2 are not electroplated piece by piece as in the prior art, thus saving much time and work.

(2) The casing 2 is electroplated after riveting and has no need to be riveted by a fixing plate such as in the case in the prior art, so that the laminated padlock can retain a good appearance.

With this invention thus explained, it is apparent that numerous modifications and variations can be made without departing from the spirit and scope of this invention. It is therefore intended that this invention be limited only as indicated in the appended claims.

I claim:

1. A laminated padlock comprising a casing which is formed of a plurality of metal plates; a shackle having two ends to be inserted into said casing; a barrel member fitted in said casing, said barrel member having a bore into which a cylinder is rotatably inserted; an activating member connected with said cylinder in said casing so as to be rotated with said cylinder; two balls disposed adjacent to said activating member for restraining the movement of said shackle; a spring member mounted in said casing for urging said shackle to move outward and a sleeve member for covering an outer surface of said casing, said sleeve member having a protrusion projecting from an inner surface thereof so as to engage with a concave portion which is formed on the outer surface of said casing at a position where said plate is depressed, wherein said barrel member has a groove formed on an outer surface thereof, one of said plates being depressed inwardly to engage with said groove of said barrel member so that said barrel member can be fixed within said casing.

* * * * *